US007635822B2

(12) United States Patent
Deiseroth et al.

(10) Patent No.: US 7,635,822 B2
(45) Date of Patent: Dec. 22, 2009

(54) METHOD FOR TREATING GROUND CRUDE POTASSIUM SALTS THAT CONTAIN KIESERITE

(75) Inventors: Florian Deiseroth, Bebra-Weiterode (DE); Peter-Michael Beier, Heringen (DE); Sascha Vensky, Bad Hersfeld (DE); Ingo Stahl, Vellmar (DE)

(73) Assignee: K+S Aktiengesellschaft, Kassel (DE)

( * ) Notice: Subject to any disclaimer, the term of this patent is extended or adjusted under 35 U.S.C. 154(b) by 238 days.

(21) Appl. No.: 11/890,413

(22) Filed: Aug. 6, 2007

(65) Prior Publication Data

US 2008/0029441 A1 Feb. 7, 2008

(30) Foreign Application Priority Data

Aug. 4, 2006 (DE) ..... 10 2006 036 467

(51) Int. Cl.
*B03C 7/00* (2006.01)

(52) U.S. Cl. ..... 209/127.1; 209/127.4

(58) Field of Classification Search ..... 209/127.1, 209/127.4

See application file for complete search history.

(56) References Cited

U.S. PATENT DOCUMENTS

| | | | | | |
|---|---|---|---|---|---|
| 3,073,447 | A | * | 1/1963 | Autenrieth et al. | 209/127.1 |
| 3,217,876 | A | * | 11/1965 | Autenrieth | 209/9 |
| 3,388,794 | A | * | 6/1968 | Peuschel | 209/9 |
| 3,477,566 | A | * | 11/1969 | Autenrieth et al. | 209/9 |
| 3,480,139 | A | * | 11/1969 | Fricke et al. | 209/9 |
| 3,591,093 | A | * | 7/1971 | Berthon et al. | 241/15 |
| 3,760,941 | A | * | 9/1973 | Singewald et al. | 209/3 |
| 3,802,556 | A | * | 4/1974 | Fricke et al. | 209/9 |
| 3,835,996 | A | * | 9/1974 | Singewald et al. | 209/9 |
| 4,767,506 | A | * | 8/1988 | Fricke | 209/127.4 |
| 5,562,755 | A | * | 10/1996 | Fricke et al. | 95/58 |
| 5,803,947 | A | * | 9/1998 | Engell et al. | 75/10.33 |
| 2006/0226051 | A1 | * | 10/2006 | Navarrette et al. | 209/166 |

FOREIGN PATENT DOCUMENTS

| | | |
|---|---|---|
| CA | 2057165 | 6/1992 |
| DE | 1 667 814 | 7/1970 |
| DE | 40 39 470 | 1/1992 |

OTHER PUBLICATIONS

G. Fricke, "Die elektrostatische Aufbereitung von Kalium- und Magnesiumsalzen" [Electrostatic treatment of potassium and magnesium salts], *Kali und Steinsalz* [Potassium and Mineral Salt], Issue Sep. 1986, pp. 278-295. (Spec, p. 1).

G. Fricke, "Die elektrostatische Aufbereitung von Kalium- und Magnesiumsalzen" [Electrostatic treatment of potassium and magnesium salts], *Kali und Steinsalz* [Potassium and Mineral Salt], Issue Sep. 1986, pp. 278-295. (Spec, p. 1) (With English translation of pertinent portions).

* cited by examiner

*Primary Examiner*—Patrick H Mackey
*Assistant Examiner*—Jeremy Severson
(74) *Attorney, Agent, or Firm*—Collard & Roe, P.C.

(57) ABSTRACT

The electrostatic separation of ground crude potassium salts containing kieserite is accomplished by mixing the ground crude potassium salt with a conditioning agent containing a combination of an aromatic carboxylic acid or its derivatives, an ammonium salt of an aromatic carboxylic acid, as well as an unbranched fatty alcohol having a chain length of $C_{10}$ to $C_{15}$, and subsequently triboelectrically charging the mixture at a relative humidity of 1-10%. The mixture is then separated into a crude kieserite fraction and a crude potassium fraction by means of an electrostatic separation method. This method increases kieserite yield and the selectivity of a subsequent treatment by means of flotation.

11 Claims, No Drawings

METHOD FOR TREATING GROUND CRUDE POTASSIUM SALTS THAT CONTAIN KIESERITE

BACKGROUND OF THE INVENTION

1. Field of the Invention

The present invention relates to the electrostatic separation of kieserite ($MgSO_4.H_2O$) from crude potassium salts, which contain not only kieserite but also other minerals such as sylvin, halite, polyhalite, langbeinite, and other salt minerals.

2. The Prior Art

It is known to isolate the mineral kieserite from crude salts of potassium beds using a dry electrostatic separation method (G. Fricke, "Die elektrostatische Aufbereitung von Kalium—und Magnesiumsalzen" [Electrostatic treatment of potassium and magnesium salts], Kali und Steinsalz [Potassium and Mineral Salt], Issue 9/1986, p. 278-295). For this purpose, the crude salt is ground, classified to a predetermined grain size, provided with a small amount of conditioning agent, usually of an organic type, and swirled up with air having a specified temperature and moisture content, triboelectrically charged, and the mixture is separated into a crude kieserite fraction and a crude potassium fraction in an electrostatic field.

German Patent No. DE 1 667 814 describes such a separation method for obtaining the mineral kieserite, in a first step, from a crude potassium salt containing kieserite, using aliphatic, unbranched fatty acids having a chain length $C_3$ to $C_{18}$, or aromatic carboxylic acids, or a mixture of the two aforementioned, as well as ammonium salts of the low aliphatic fatty acids, preferably ammonium formiate and ammonium acetate, as conditioning agents, at a relative humidity of 5% to 40%, preferably 10% to 30%.

In German Patent No. DE 4 039 470 C1, a conditioning agent formulation is listed that is composed of the substances salicylic acid, fatty acid, and ammonium acetate. According to the method described, air having a relative humidity of 5% is used for conditioning.

In the case of this formulation, however, it has been shown in practice that the substances used here bring about problems in a flotative treatment of the crude potassium fraction that follows the electrostatic treatment. Thus, the fatty acid used can lead to unselective hydrophobization of all of the mineral phases in flotation. Also, there are handling difficulties due to the hygroscopic properties of ammonium acetate. It was also shown that under these conditions, as much as about 20% of the kieserite contained in the crude salt cannot be separated into the crude kieserite fraction, but rather is lost in the crude potassium fraction.

SUMMARY OF THE INVENTION

It is therefore an object of the invention to provide a conditioning agent with which the selectivity of the electrostatic separation of kieserite from a crude potassium salt can be increased. It is another object of the invention to improve the handling properties of the conditioning agent, such as uniform wettability of the goods to be separated. It is another object of the invention to provide a conditioning agent that does not exert a negative influence on the selectivity of a subsequent flotation process, as a result of conditioning agent residues that adhere to the separation products, such as the crude potassium fraction, for example.

This object is accomplished by means of a combination of conditioning agents that is formed from an aromatic carboxylic acid, an ammonium salt of an aromatic carboxylic acid, and an unbranched fatty alcohol. In this connection, derivatives of aromatic carboxylic acids can also be used; the known acetylsalicylic acid is preferred. The ammonium salt of the aromatic carboxylic acid is preferably ammonium benzoate.

Mixtures having chain lengths of $C_{10}$ to $C_{15}$ are possible as fatty alcohols. Conditioning of the crude potassium salt to be separated takes place in known manner, in a suitable mixer, for example in a fluidized bed, in which the salt mixture is simultaneously triboelectrically charged. In this connection, charging takes place at a relative humidity of 1 to 10 percent. Preferably, charging and separation take place between 1 and 4 percent; between 2 and 3 percent relative humidity is particularly preferred. Separation of the crude potassium salt into a crude kieserite fraction and a crude potassium fraction is carried out in an electrostatic separator, preferably in a free-fall separator.

The separation method can be carried out in one or more stages.

The conditioning agent combination develops its optimal effect on the separation process if the components are used in the following amounts, with reference to the amount of crude salt:

| | |
|---|---|
| aromatic carboxylic acid (acetylsalicylic acid): | 20 to 100 g/t, preferably 30 to 50 g/t |
| ammonium salt of the aromatic carboxylic acid (ammonium benzoate): | 10 to 75 g/t, preferably 15 to 25 g/t |
| fatty alcohol: | 10 to 50 g/t, preferably 20 to 30 g/t |

In one embodiment of the method, flotation of the crude potassium fraction follows the electrostatic separation, and a potassium chloride concentrate is floated with known flotation agents. The conditioning agent combination according to the invention has a particularly positive effect on the selectivity of the potassium chloride flotation, as compared with the known combination of conditioning agents, which contains fatty acids, among other things. The selectivity is not impaired in any way.

In another embodiment, the crude kieserite fraction is processed further in a subsequent kieserite flotation process, to yield a high-percentage kieserite concentrate. Flotation is a separation technique used widely in the minerals industry for paper recycling, de-inking and water treatment, among others. It is a method for the separation of different materials from a mixture suspended and dispersed in water. The technique relies on differences in the surface properties of different particles (be it salt or other minerals) to separate them. These differences may result in varying wettabilities, which can also be modified by the addition of appropriate chemicals, so called collectors. The particular collector used depends on the mineral that is being refined.

By this modification, one component of the mixture becomes water-repellent (hydrophobic), while the other component has a high affinity for water (hydrophilic). Then, air is bubbled through the mixture and the hydrophobic particles become attached to the small air bubbles and move to the surface where they accumulate as a froth and are then collected. The hydrophilic particles remain in suspension. This flotation process can be used in the present invention to separate particles of potassium chloride from other salts. In the present invention, the flotation process is sued to further increase the potassium chloride content by making the potassium chloride particles hydrophobic, transferring them by air bubbles to the surface and separating the froth from the remaining suspension.

Subsequent further concentration of potassium chloride and/or kieserite can also take place in a solution process that follows the electrostatic separation. A solution process is also called a hot leaching process. This process is a well-known industrial process that use used to produce potassium chloride from potash ore. The solution process is a technique that enables separation of salts by using their different temperature dependence of solubility. By varying the temperature of a solution of a mixture of salts, one component precipitates, while the other component remains in solution. In the solution process used in the invention, this technique is used to further increase the potassium chloride content.

DETAILED DESCRIPTION OF THE PREFERRED EMBODIMENT

The invention will be explained in greater detail using the following exemplary embodiments. Separation experiments on a small technical scale are described, and the results of electrostatic separation of a kieserite hard salt using the conditioning agents according to the state of the art are compared with the results using the conditioning agent combination according to the invention, under different experimental conditions, such as varied relative humidity. The results of the experiments, with regard to the contents and the yields of the salt components in the crude potassium fraction and in the crude kieserite fraction, are shown in Table 1.

EXAMPLE 1

A ground crude potassium salt having the following composition was separated:

Sylvin (KCl) 16.7%; kieserite ($MgSO4.H_2O$) 31.8%; ascharite ($Mg_2[OHB_2O_4(OH)]$) 0.6%; anhydrite ($CaSO_4$) 0.6%; halite (NaCl) 48.6%. The crude salt was ground to an average grain size of 1.2 mm and mixed with an amount of approximately 50-75 g/t conditioning agent consisting of the components salicylic acid, ammonium acetate, and fatty acid (KPK 12-18).

The outside air was brought to a relative humidity of approximately 5% and the temperature of the air was adjusted to approximately 70° C., and the crude potassium salt was separated in a free-fall separator after triboelectric charging had taken place, into a crude kieserite fraction and a crude potassium fraction.

EXAMPLE 2

A crude potassium salt according to Example 1 was electrostatically separated at the same relative humidity and temperature, whereby 50-75 g/t of a mixture of acetylsalicylic acid, ammonium benzoate, and fatty alcohol (Kalcol 2470) were used as the conditioning agent.

EXAMPLE 3

The same crude potassium salt as in Examples 1 and 2 was electrostatically separated at a relative humidity of 2.5% and a temperature of 80-84° C., and the conditioning agent of the state of the art was used.

EXAMPLE 4

The crude potassium salt according to Examples 1-3 was electrostatically separated under the same conditions of relative humidity and temperature according to Example 3, and the conditioning agent combination according to the invention was used.

TABLE 1

| | Example (1) State of the art | | Example (2) Invention | | Example (3) State of the art | | Example (4) Invention | |
|---|---|---|---|---|---|---|---|---|
| | Content in % | Yield in % | Content in % | Yield in % | Content in % | Yield In % | Content in % | Yield in % |
| Relative humidity | 5.0% | | 5.0% | | 2.5% | | 2.5% | |
| Crude potassium fraction | | 71.0 | | 69.3 | | 72.4 | | 69.3 |
| Effective amount in % | 13.9 | 96.0 | 14.0 | 95.8 | 13.8 | 96.8 | 14.2 | 95.8 |
| $K_2O$ | 2.4 | 17.3 | 1.8 | 12.7 | 1.8 | 14.4 | 1.3 | 9.5 |
| MgO | 22.1 | 96.1 | 22.1 | 95.8 | 21.9 | 96.8 | 22.5 | 95.7 |
| Sylvin | 7.5 | 16.2 | 5.6 | 11.8 | 5.6 | 13.4 | 3.9 | 8.6 |
| Kieserite | 0.4 | 55.0 | 0.3 | 42.9 | 0.4 | 53.8 | 0.3 | 40.4 |
| Ascharite | 0.6 | 74.6 | 0.4 | 56.3 | 0.4 | 67.7 | 0.3 | 49.2 |
| Anhydrite | 68.2 | 98.9 | 69.8 | 98.8 | 70.2 | 99.2 | 72.2 | 98.9 |
| Mineral salt | | | | | | | | |
| Crude kieserite | | 29.0 | | 30.7 | | 27.6 | | 30.7 |
| fraction | 1.4 | 4.0 | 1.4 | 4.2 | 1.2 | 3.2 | 1.4 | 4.2 |
| Effective amount in % | 28.0 | 82.7 | 27.9 | 87.3 | 28.1 | 85.6 | 27.9 | 90.5 |
| $K_2O$ | 2.2 | 3.9 | 2.2 | 4.2 | 1.9 | 3.2 | 2.3 | 4.3 |
| MgO | 94.9 | 83.8 | 94.4 | 88.2 | 95.1 | 86.6 | 94.1 | 91.4 |
| Sylvin | 0.8 | 45.0 | 0.9 | 57.1 | 0.9 | 46.2 | 1.0 | 59.6 |
| Kieserite | 0.5 | 25.4 | 0.7 | 43.7 | 0.5 | 32.3 | 0.7 | 50.8 |
| Ascharite | 1.8 | 1.1 | 1.9 | 1.1 | 1.4 | 0.8 | 1.8 | 1.1 |
| Anhydrite | | | | | | | | |
| Mineral salt | | | | | | | | |

A comparison of Examples 1 and 2 (relative humidity 5%) according to Table 1 shows the following significant results: Using the methods according to the invention, using the conditioning agent combination acetylsalicylic acid, ammonium benzoate, and fatty alcohol, a kieserite yield that is better by 4.4 percentage points is achieved, with approximately the same yield of $K_2O$ and mineral salt in the crude potassium fraction.

A comparison of Examples 1 and 3 (relative humidity 2.5%) shows that it was possible to increase the yield of kieserite in the crude kieserite fraction by 2.8 percentage points, and the yield of $K_2O$ in the crude potassium fraction by 0.8 percentage points, and that of mineral salt by 0.3 percentage points.

If one compares the experimental results of Examples 1 and 4 (relative humidity 5%, conditioning agent according to the state of the art, as compared with relative humidity 2.5%, conditioning agent combination according to the invention), this shows an increase in the kieserite yield by 10 percentage points, with approximately the same values for the $K_2O$ yield and the mineral salt yield.

Replacing the fatty acid by fatty alcohol as a conditioning agent in the electrostatic treatment results in greater selectivity during subsequent treatment by means of flotation, and thus, in total, to an improved yield of desired material.

Accordingly, while only a few embodiments of the present invention have been shown and described, it is obvious that many changes and modifications may be made thereunto without departing from the spirit and scope of the invention.

What is claimed is:

1. A method for the treatment of ground crude potassium salts containing kieserite, for the production of a crude kieserite fraction and a crude potassium fraction, comprising the following steps:

a) intensively mixing the ground crude potassium salt with a conditioning agent containing a combination of an aromatic carboxylic acid or its derivatives, an ammonium salt of an aromatic carboxylic acid, and an unbranched fatty alcohol having a chain length of $C_{10}$ to $C_{15}$, and b) subsequently triboelectrically charging the mixture at a relative humidity of 1-10%; and c) separating the mixture into a crude kieserite fraction and a crude potassium fraction by an electrostatic separation method.

2. A method according to claim 1, further comprising the step of obtaining a potassium chloride concentrate from the crude potassium fraction in a flotation process after said step of separating.

3. A method according to claim 1, further comprising treating the crude potassium fraction in a solution process after said step of separating to obtain a potassium chloride product.

4. Method according to claim 1, further comprising the step of treating the kieserite fraction in a solution process after said step of separating to obtain a kieserite product.

5. A method according to claim 1, further comprising the step of obtaining a kieserite concentrate from the kieserite fraction, in a flotation process, after said step of separating.

6. A method according to claim 1, wherein acetylsalicylic acid is used as the aromatic carboxylic acid.

7. A method according to claim 1, wherein ammonium benzoate is used as the ammonium salt of the aromatic carboxylic acid.

8. A method according to claim 1, wherein triboelectric charging takes place at a relative humidity between 1% and 6%.

9. A method according to claim 1, wherein 20 to 100 g/t of aromatic carboxylic acid are used, with reference to the amount of crude potassium salt.

10. A method according to claim 1, wherein 10 to 75 g/t, of ammonium salt of aromatic carboxylic acid are used, with reference to the amount of crude potassium salt.

11. A method according to claim 1, wherein 10 to 50 g/t of fatty alcohol are used, with reference to the amount of crude potassium salt.

* * * * *